US010241457B1

(12) United States Patent
Alexandrovich et al.

(10) Patent No.: US 10,241,457 B1
(45) Date of Patent: Mar. 26, 2019

(54) PROCESS CONTROL SENSING OF TONER COVERAGE

(71) Applicant: Eastman Kodak Company, Rochester, NY (US)

(72) Inventors: Peter S. Alexandrovich, Rochester, NY (US); Rodney R. Bucks, Webster, NY (US); Tomas G. P. McHugh, Webster, NY (US); Jerry A. Pickering, Hilton, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 15/875,211

(22) Filed: Jan. 19, 2018

(51) Int. Cl.

| | |
|---|---|
| ***G03G 15/00*** | (2006.01) |
| ***G03G 15/18*** | (2006.01) |
| ***G03G 9/08*** | (2006.01) |
| ***G03G 15/08*** | (2006.01) |
| ***B41M 7/00*** | (2006.01) |

(52) U.S. Cl.
CPC ..... *G03G 15/556* (2013.01); *B41M 7/0009* (2013.01); *G03G 15/18* (2013.01); *G03G 9/08* (2013.01); *G03G 15/0865* (2013.01)

(58) Field of Classification Search
CPC .. G03G 15/0865; G03G 15/18; G03G 15/556; G03G 9/08
See application file for complete search history.

(56) References Cited

U.S. PATENT DOCUMENTS

| | | | | |
|---|---|---|---|---|
| 3,879,314 | A | 4/1975 | Gunning et al. | |
| 3,923,704 | A | 12/1975 | Gunning et al. | |
| 4,137,380 | A | 1/1979 | Gunning et al. | |
| 4,254,201 | A | 3/1981 | Sawai et al. | |
| 4,379,825 | A | 4/1983 | Mitushashi | |
| 4,461,849 | A | 7/1984 | Karickhoff | |
| 4,489,174 | A | 12/1984 | Karickhoff | |
| 4,833,060 | A | 5/1989 | Nair et al. | |
| 5,409,776 | A | 4/1995 | Someya et al. | |
| 5,410,388 | A | 4/1995 | Pacer et al. | |
| 5,436,705 | A | 7/1995 | Raj | |
| 5,519,497 | A * | 5/1996 | Hubble, III | G01N 21/55 356/445 |
| 5,608,017 | A | 3/1997 | Kamiyama et al. | |
| 5,625,857 | A | 4/1997 | Shimada et al. | |
| 5,991,558 | A | 11/1999 | Emi et al. | |
| 6,207,338 | B1 | 3/2001 | Ezenyilimba et al. | |
| 6,380,297 | B1 | 4/2002 | Zion et al. | |

(Continued)

*Primary Examiner* — Gregory H Curran
(74) *Attorney, Agent, or Firm* — Kevin E. Spaulding

(57) ABSTRACT

A toner coverage sensing system is provided for sensing toner particles printed onto a surface of a process element using an electrophotographic printing system. The printed toner particles include porous color toner particles. An infrared radiation source directs infrared radiation onto the printed toner particles on the surface of the process element A diffused radiation detector senses infrared radiation scattered from the printed toner particles, wherein the diffused radiation detector is oriented such that that the sensed infrared radiation does not include specular reflections from the surface of the process element. A data processing system determines a sensed toner coverage for the porous color toner particles on the surface of the process element responsive to the sensed scattered infrared radiation.

12 Claims, 9 Drawing Sheets

(56) References Cited

U.S. PATENT DOCUMENTS

| | | | | |
|---|---|---|---|---|
| 6,482,562 | B2 | 11/2002 | Ezenyilimba et al. | |
| 7,368,212 | B2 | 5/2008 | Sugiura et al. | |
| 7,572,846 | B2 | 8/2009 | Englebrecht et al. | |
| 7,741,378 | B2 | 6/2010 | Cui | |
| 7,754,409 | B2 | 7/2010 | Nair et al. | |
| 7,867,679 | B2 | 1/2011 | Nair et al. | |
| 7,887,984 | B2 | 2/2011 | Nair et al. | |
| 8,252,414 | B2 | 8/2012 | Putnam et al. | |
| 9,005,867 | B2 | 4/2015 | Mang et al. | |
| 9,020,380 | B2 | 4/2015 | Shida | |
| 9,029,431 | B2 | 5/2015 | Nair et al. | |
| 9,376,540 | B2 | 6/2016 | Boris et al. | |
| 2006/0127110 | A1* | 6/2006 | Borton ..... | G03G 15/0877 399/30 |
| 2012/0077000 | A1 | 3/2012 | Putnam et al. | |
| 2013/0011782 | A1 | 1/2013 | Sano et al. | |

* cited by examiner

50

PROCESS CONTROL SENSING OF TONER COVERAGE

FIELD OF THE INVENTION

This invention pertains to the field of electrophotographic printing, and more particularly to an improved toner coverage sensing system for sensing an amount of toner deposited per unit area.

BACKGROUND OF THE INVENTION

Electrophotography is a useful process for printing images on a receiver medium (or "imaging substrate"), such as a piece or sheet of paper or another planar medium, plastic, glass, fabric, metal, or other objects as will be described below. In this process, an electrostatic latent image is formed on a photoreceptor by uniformly charging the photoreceptor, and then via exposure with light discharging selected areas to yield an electrostatic charge pattern corresponding to the desired image (i.e., a "latent image").

After the latent image is formed, charged toner particles are brought into the vicinity of the photoreceptor and are attracted to the latent image to develop the latent image into a visible image. Numerous methods of development of the latent electrostatic image with charged toner particles are available. Liquid development with insulating carrier fluids including suspended charged toner particles can be used, as can processes using dry toner particles. Common dry toning processes include both mono-component and two-component toning systems. Mono-component toning systems generally apply dry toner particles to a development roller by way of a foam roller, a doctor blade, or both; the development roller then presents the charged toner to the electrostatic latent image on the photoreceptor. Two-component toning systems usually include toner particles and oppositely charged magnetic carrier particles, the mixture of which is called a two-component developer. The two-component developer is attracted to a magnetic brush toning apparatus, which then supplies the developer to the latent electrostatic image. Note that the visible image might not be easily visible to the naked eye depending on the composition of the toner particles. The practice of the present invention is described in terms of dry toner processes, but is not confined to such.

Control of the quantity of toner deposited on the final receiver is critical to the proper performance of the electrophotographic printing device. A typical process control system utilizes a method of sensing the amount of toner deposited, and reacts to the result of such a measurement by controlling imaging process parameters to keep the amount of toner at a desired optimal level. Although there are many methods available to accomplish the sensing of the amount of toner deposited, the present disclosure relates to an optical sensing method operating at infrared light wavelengths. The amount of toner deposited is referred to as toner coverage, developed mass per unit area (DMA), and image density, among others. These terms are taken to be synonymous. DMA is usually specified in units of milligrams per square centimeter, or $mg/cm^2$.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., aggregated from a dispersion of a pigment and latex resin particles, or prepared from an organic phase comprising toner ingredients and a solvent suspended in an aqueous phase followed by removal of the organic solvent), as is known in the art. Toner particles can have a range of diameters, for example, less than 8 on the order of 10-15 or up to approximately 30 Diameter refers to the volume-weighted median diameter, as determined by a device such as a Coulter Multisizer. Toner is also referred to in the art as marking particles, dry ink, or developer in the case of mono-component toning sub-systems.

Toner includes toner particles, and can also include other particles. Any of the particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides), adhesion to the receiver (e.g., binders), electrical conductivity or low magnetic reluctance (e.g., metal particles), electrical resistivity, texture, gloss, magnetic remanence, fluorescence, resistance to etchants, and other properties of additives known in the art. Toner particles themselves can be coated with even finer particles known as surface treatment agents. Such fine particles can be sub-micron to a few microns in size, and are added to enhance properties such as the free flow ability of the bulk toner powder, the toner triboelectric charging characteristics, and the toner transfer efficiency. Surface treatment agents in common use include pyrogenic silica, colloidal silica, titania, alumina, and fine resin particles, among others. The surface treatment agents themselves are commonly coated with compounds including a wide variety of types of silanes and silicones.

Toner particles can be substantially spherical or non-spherical. The shape of toner can have a large influence on its performance in the electrophotographic process, and factors in the toner manufacturing process can be used to control the shape but can also introduce unintentional shape variability. For example, the shape of toner can affect electrostatic transfer efficiency, bulk powder flow properties which affect behavior in the toner replenisher hopper, and bulk powder flow properties of two-component developers. The latter can affect the amount of developer fed to the toning roller and thus the resulting image DMA and optical density. Toner particle shape also has an effect on the scattering of light, including at infrared wavelengths. Highly shaped toners reflect or scatter more light than less shaped toners at a given DMA; spherical toners scatter the least light. Toner particle shape particularly affects the ability of a mono-component toning subsystem to provide a smooth layer on the development roller through action of the foam application roller and the doctor or metering blade. In general, smoother shapes perform better, with the result of a trade-off of lower sensitivity of the DMA sensor. Toner particle shape can be variable according to natural but unwanted variation in toner manufacturing processes. Thus, there is the need to provide a DMA sensing system that provides improved robustness to variations in toner shape.

The most common toner particles are solid in that they contain resins, colorants, additives and the like, but not voids which contain air. Toner particles can however be porous in that they can contain voids, vesicles, pores, cavities or inclusions of air. The voids can be discrete or interconnecting. The words voided, vesiculated, porous, foamed and expanded are taken to be synonymous.

After the latent image is developed into a toner image on the photoreceptor, a suitable receiver is brought into juxtaposition with the toner image. A suitable electric field is applied to transfer the toner particles to the receiver (e.g., a piece of paper) to form the desired print image. The imaging process is typically repeated many times with reusable photoreceptors. The photoreceptor is typically in the form of a drum or a roller, but can also be in the form of a belt. In some configurations, the toner image is first transferred to an intermediate transfer member, from which the visible image is further transferred to the final receiver. Thermal transfer processes are also useful in the same manner.

The receiver is then removed from its operative association with the photoreceptor or intermediate transfer member and subjected to heat or pressure to permanently fix (i.e., "fuse") the print image to the receiver. A plurality of print images (e.g., of separations of different colors) can be overlaid on one receiver before fusing to form a multi-color print image on the receiver.

The electrophotographic printing process as just described is characterized by plural sub-systems that influence the amount of toner transferred to the final receiver; these sub-systems can change their behavior over time or in response to conditions experienced by the printing process. Process control sub-systems are commonly employed that can manipulate the operating parameters of such variable imaging subsystems to maintain the amount of toner transferred to the ultimate receiver at a desired level. For example, in dry two-component development sub-systems, the concentration of toner in the developer mixture comprising toner particles and magnetic carrier particles (% TC), influences the amount of toner developed. Usually higher % TC leads to higher toner developed mass per unit area (DMA) due to factors including an increase in the rate of development and a decrease in the charge per mass of the toner itself. Magnetic toner concentration monitors are used to measure % TC and thus enable control of the rate of addition of replenisher toner to the developer in order to keep % TC at the desired value as toner is removed at variable rates due to variable coverage product images. Process control sub-systems can also control the rate of replenishment of toner and thus % TC through knowledge of the coverage amounts specified in the digital files to be printed. Other process control strategies let % TC vary according to the signal from a sensor that records the DMA at some point in the process such as on the photoreceptor after toning, or on an intermediate transfer member, or on the output images themselves. For example, if the operating environment becomes less humid and causes an increase in charge per mass of the toner and a resulting decrease in DMA, the signal from the DMA sensor is responded to by increasing the rate of replenishment and thus increasing % TC in order to bring the DMA back up to the desired value. This is a simple and common process control scheme, that depends on the sensitivity and robustness of the DMA sensing method to produce optimal output image quality and stability. Thus, there is a need for sensitive and robust developed mass per unit area sensing as described by the present invention. Note that a developed mass per unit area (DMA) sensor can also be referred to as an image density control (IDC) sensor or a toner coverage sensor.

Photoreceptors typically do not maintain stable discharge response to light over time or use. The degree to which they can be discharged, the surface potential to exposure contrast, and the efficiency at which they can be charged are subject to change. Process control sub-systems may include surface potential sensors which the control system responds to by selecting charging voltages and exposure levels in order to help maintain DMA at a desired level. Such changes may likely require changes to control parameters in the toning sub-system such as the toning roller bias voltage level in order to maintain the desired DMA and toner background level of an output print. Changes in the gain of the development sub-system lead to DMA changing in an unwanted manner. Examples include % TC variability, changes in humidity and temperature that result in toner charge per mass changes, developer aging processes and lot-to-lot variability in toner tribocharging properties, among others. In order to overcome these and other electrophotographic process instabilities, modern process control methods usually employ DMA sensing feeding back to photoreceptor charging voltages and exposure levels in combination with changes to development sub-system parameters in order to keep DMA and the resulting image density at the desired levels. There is thus a need for highly sensitive and robust methods of measuring the developed mass per unit area of toner. There is also a need to keep the cost of the DMA sensing subsystem to as low as possible in order for printers and equipment manufacturers to thrive in today's competitive business climate.

A common architecture of a color printer includes four imaging modules, one for each of the cyan, magenta, yellow and black primary colors, operating together continuously in a parallel process. Each imaging module includes the necessary sub-system components including the photoreceptor, charging means, exposure means, development means, cleaning means, etc. Such imaging modules are arranged around an intermediate transfer belt, to which the four color toner images are sequentially transferred in register from the four photoreceptors. In this manner, the complete image is formed on the transfer belt, from which a final transfer is made to the ultimate receiver such as a sheet of paper. The transfer belt commonly has static dissipative properties; the necessary level of resistance is usually achieved through the use of carbon black as a conductive filler. Thus, most intermediate transfer belts are opaque and black in color. Thus, the developed mass per area (DMA) sensor typically cannot be a transmission densitometer measuring the absorbance of color process control patches through the intermediate transfer belt. A typical sensor used to measure the DMA of cyan, magenta, and yellow process control patches as transferred to the intermediate web instead measures the amount of light scattered by the toner in such patches at infrared wavelengths of light. Thus, there is a need for sensitive and robust sensing to measure scattered light at infrared wavelengths. The black toner presents a special case, as carbon black is typically used as the black colorant and carbon black is a strong absorber in the infrared. The black toner DMA sensor in such printers is based on the absorbed infrared light from a process control patch on the belt. The geometry of the sensor is such that the detector is arranged to collect light reflected from the glossy surfaced intermediate belt, which is then modulated by the DMA of the black toner.

U.S. Pat. No. 5,410,388 to Pacer et al. describes a process control scheme to compensate for toner concentration drift of a two-component development system due to developer aging effects. A sensor configured to measure reflectance is used to detect lead and trail edge densities of large process control patches on a web-based photoreceptor, which are responded to by controlling parameters such as toner concentration, development bias voltage and photoreceptor potential to keep image quality constant. The sensor is based on a semiconductor light emitting diode with a 940 nm peak wavelength and a 60 nm one-half power bandwidth. The use of an infrared wavelength reflective sensor detecting toner patches on a photoreceptor is thus illustrated. U.S. Pat. No. 5,436,705 to Raj provides another example of TAC (toner area coverage) measurement on the photoreceptor using an infrared reflectance sensor. Both references refer to black and white processes.

U.S. Pat. No. 5,991,558 to Emi et al. describes the use of a reflective sensor, operating with light at infrared wavelengths, where there is a single emitter and two detectors. One detector is oriented to the base medium at the equivalent angle to that of the emitter, such that specularly reflected light from the base medium is detected when there is no toner on the medium. If the base medium is a typical black intermediate transfer belt, the presence of a patch of carbon-black-based black toner provides a lower signal; thus, a measure of the coverage of the black toner is characterized. For color toners without carbon black, a greater signal-to-noise is realized when the detector is oriented to collect only light that is diffused, which is greater when toner is present than not. In this manner, the coverage of color toners such as cyan, magenta and yellow are measured. The sensor operates in the infrared, at 970 nm.

FIG. 1, adapted from U.S. Pat. No. 5,991,558, illustrates the positions of the emitter and the two detectors, one oriented at the equivalent angle to that of the emitter to collect light specularly reflected from the media, and one mounted at an angle to collect scattered or diffused light. Herein the words scattered light and diffused light are used interchangeably. A toner coverage sensor 31 (i.e., a DMA sensor) is placed in opposition to the process element 1 (e.g., media) where toner images will be located to be sensed. The toner coverage sensor 31 includes an infrared emitter element 32 (e.g., an LED) which illuminates the process element 1 at an illumination angle $\alpha$. A specular radiation detector 34 is oriented to detect light which is specularly reflected from the process element 1. A diffused radiation detector 36 is oriented to detect diffuse light which is scattered by toner particles on the surface of the process element 1. The patent discloses selective use of one or the other of the detectors depending on the coverage of the test patch of toner to optimize the detected signal. FIG. 2, also adapted from U.S. Pat. No. 5,991,558, illustrates the sensor output 46 for color toner using the diffused radiation detector 36, and the sensor output 44 for black toner using the specular radiation detector 34. A data processing system (not shown) can be used to determine the toner coverage from the sensor output using calibration functions determined by characterizing the sensor output as a function of toner coverage. Developed mass per unit area sensors with this orientation scheme of one emitter and two detectors are in common use in the electrophotographic printer industry.

A graph 50 showing the absorbance of light as a function of wavelength for a representative commercially available set of cyan, magenta, yellow and black toners is illustrated in FIG. 3. These spectral absorbance functions were measured for toner samples removed from the C504S, M504S, Y504S and K504S cartridges used in a Samsung Xpress C1810W printer were electrostatically coated onto a clear film support at a coverage of approximately 0.4 mg/cm$^2$, fused in a roller fuser apparatus to leave a smooth, uniform and continuous layer of toner, and measured for optical absorbance in transmission as a function of wavelength from 350 nm to 1050 nm on a Perkin-Elmer UV-VIS model Lambda 35 spectrophotometer. It can be seen that for the cyan, magenta and yellow colorants used in these toners there is essentially no absorption of light above 850 nm in the infrared region of the spectrum. In an exemplary configuration, the color toners absorb less than 5% of the radiation in the infrared wavelength band sensed by the toner coverage sensor 31 as measured by the method used in FIG. 3, where a toner deposit of 0.4 mg/cm$^2$ fused to a G60 gloss of at least 20 on clear support is measured for optical absorbance in transmission at the wavelengths in the infrared wavelength band of the toner coverage sensor 31.

The Samsung C1810W printer uses a toner coverage sensing system with the geometry illustrated in FIG. 1, sensing the toner coverage on a smooth (shiny) black intermediate transfer element. The light from the emitter element 32 of the toner coverage sensor 31 was measured to be centered at approximately 930 nm. Thus, to measure toner coverage (i.e., the DMA) of the primary cyan, magenta and yellow color toners, the process control sensor detects the reflection of 930 nm infrared light with the diffused radiation detector 36. The greater the amount of toner per unit area, the greater the amount of light that is scattered, thus the greater the signal detected by the diffused radiation detector 36. On the other hand, for the black toner, where carbon black is the primary colorant, light is absorbed at significant levels from 850-1050 nm. Thus, infrared light will be largely absorbed rather than scattered and detection is accomplished using the specular radiation detector 34 where the presence of black toner on the smooth black colored intermediate transfer element will lower the amount of specularly reflected light.

Many pigments and dyes have been used as the colorants in commercially available cyan, magenta, and yellow toners. The large majority do not significantly absorb light at wavelengths from about 850-1050 nm, and are thus optimally detected using a diffused radiation detector 36 operating in this range of infrared wavelengths.

U.S. Pat. No. 5,625,857 to Shimada et al. describes a deposited toner amount sensor where the light receiving element has a wide light-receiving area to receive at least a part of irregularly reflected (scattered) light besides specularly reflected light. The use of such a complex sensor illustrates the need to improve the sensing of cyan, magenta and yellow toners. The advantage of using infrared light is described in column 6, lines 41-48, where it is noted that doing so thus reduces effects caused by differences of color toners.

U.S. Pat. No. 9,020,380 to Shida describes toner coverage sensing using devices operating at 950 nm, with geometries including a single emitter and two detectors arranged so as to separately collect specularly reflected light and scattered light. FIG. 3 of U.S. Pat. No. 9,020,380 describes a sensor of geometry essentially identical to that of FIG. 1 discussed earlier. FIG. 1 of U.S. Pat. No. 9,020,380 shows an embodiment where such a sensor is set up to measure patches of unfused toner transferred to an intermediate transfer belt element. It is stated that "in order to detect a test pattern with a sensor, the test pattern must be made larger than the spot diameter of the light irradiated by the sensor. On the other hand, the developer consumed in density control is considered wasted consumption on the part of the apparatus by the user, and must be reduced as much as possible" (col. 1, lines 44 to 49). Thus, the need for improved process control sensing where a minimal amount of toner in a test patch can yield a larger signal-to-noise is desirable.

U.S. Pat. No. 3,879,314 to Gunning et al. discloses a process for making porous polyester granules designed for use in paints. The authors state that "if vesiculated polymer granules in which the vesicles are vapor-filled are incorporated in a paint composition, they can, unlike extender pigments used hitherto as flatting agents in paint, contribute opacity to a dry film of the paint by reason of their vesiculated structure" (col. 1, lines 25 to 30). The particle making process includes preparing an aqueous dispersion of a pigment, dispersing this fluid as droplets in an unsaturated polyester dissolved in a polymerizable monomer, dispersing the resulting mixture as droplets in water containing dispersing and thickening components, followed by polymerization. The pores or vesicles result after drying of the droplets of the internal water phase containing the pigment. This is known in the art as the "double emulsion" method. The granules described are however too large for use as a modern toner.

U.S. Pat. No. 3,923,704 and U.S. Pat. No. 4,137,380, both to Gunning et al., disclose improved processes for making porous polyester granules designed for use in paints. The granules are of particular use as opacifying matting agents in latex paints and avoid the defect observed hitherto of cracking at high film builds. Formulation improvements over that of the U.S. Pat. No. 3,879,314 reference are described.

U.S. Pat. No. 4,461,849 and U.S. Pat. No. 4,489,174, both to Karickhoff, describe improved processes of manufacturing vesiculated beads which have special utility as opacifying agents for paints and show improved scattering efficiency and resistance to shrinkage upon drying. As with the prior three references just described, a water-in-oil-in-water emulsion, or double emulsion method, is used. The vesiculated beads are about 0.1 to 500 microns in diameter; vesicle diameters range from about 0.01 to 5.0 microns, preferably from 0.03 to about 1.0 micron.

U.S. Pat. No. 7,572,846 to Engelbrecht et. al. describes improved vesiculated particles for use in paints. The particle preparations described are variants of the double emulsion polymerization method. The use of cross-linking and suitable hydrophobic monomers is described such that the particles are left with a hydrophobic surface that is said to hinder the re-entry and re-adsorption of water when the cross-linked particles are dry. Improved opacity, whiteness, scrub resistance and water resistance of paints are said to be realized.

U.S. Pat. No. 5,409,776 to Someya et. al. discloses a multi-shell emulsion particle of dry state structure having one or more penetrating pores connecting the surface layer of the particle with the interior of the particle. The particles are prepared by emulsion polymerizing a mixture of monomers including 5% to 80% of an unsaturated carboxylic acid to form particles which are then added to a second emulsion polymerization step with vinyl monomers at a specified ratio with the first emulsion particles, followed by treating the resultant multi-shell emulsion polymer with an alkaline material to neutralize and swell the polymer. A third polymerization step is optional after the neutralization or swelling step. The emulsion particles are said to offer improved hiding power and brightness as an organic pigment.

U.S. Pat. No. 5,608,017 to Kamiyama et. al. discloses a suspension polymerization method for producing polymerized particles having cavities in the particles. The method described is essentially a double emulsion method where the monomer(s) to be suspension polymerized are suspended at the desired droplet size in water, where the monomer droplets themselves also contain dispersed droplets of an incompatible liquid such as water. The cavities are created by drying the polymerized particles. The particles are said to be useful as space retention agents, lubricity providing agents, functional carriers, standardization particles, toners, functional fillers, and the like. The reference does not discuss the light scattering properties of such cavity containing particles.

U.S. Pat. No. 7,741,378 to Cui describes polymerization methods to prepare spherical, monodisperse porous acrylic particles. Monodisperse polymethylmethacrylate seed particles are swollen with oil-soluble polymerization initiators, monomers including methyl methacrylate and divinylbenzene to 20 to 80 times the mass of the original seed particles, followed by polymerizing the monomers. The porous monodispersed particles that result are said to be usable as a carrier that can incorporate a variety of pigments, pharmaceutical agents, and the like, and are suitable for use as various types of adsorbents, columns, and the like, because of their porosity. Moreover, the colored monodispersed particles according to the invention are monodispersed and spherical, while containing a large amount of pigment. The colored monodispersed particles are thus described as being usable as a display element of electronic paper, a spacer for liquid crystal display panels, a toner for printers, a cosmetic product, and the like. The reference does not discuss the light scattering properties of such particles.

U.S. Pat. No. 4,254,201 to Sawai et. al. discloses a toner capable of being fixed by pressure alone rather than being fixed by fusing at high temperatures. The toner consists of porous aggregates or clusters of individual granules of a pressure-sensitive adhesive substance, each granule being encapsulated by a coating film of a film-forming material. The toner is prepared by granulating spray dried particles. The porosity is important to the ability of the toner to be pressure fixed. The reference does not discuss the light scattering properties of such toner particles.

U.S. Pat. No. 4,379,825 to Mitushashi discloses a porous electrophotographic toner and a process to prepare such a toner. The toner is prepared by mixing and kneading under heat ingredients including coloring matter, a binder, and an elimination compound, pulverizing the resultant mixture, and removing the elimination compound by treating the powder with a solvent. The elimination compound must be chosen to be of the desired pore size, and so as to not melt during the high temperature kneading step. Examples given of the elimination compounds include dyestuffs which can be removed with an organic solvent which is not a solvent for the binder, and sodium chloride, sodium carbonate or saccharose starch which can be removed by water where water is also not a solvent for the binder. The advantage of the toner is said to be its ability to be pressure fixed under low pressure. The reference does not discuss the light scattering properties of such a toner particle.

U.S. Pat. No. 7,368,212 to Sugiura et. al. describes porous toner particles with a specified degree of porosity, size of pores, and toner circularity. The particles are prepared by dispersing in water a solvent containing the necessary components to form toner including a prepolymer which is then reacted to become elongated or cross-linked and components that undergo a degassing process to liberate a gas such as carbon dioxide which causes the pores to be formed. The advantage of the toner is said to be the ability to the lower the developed mass per unit area, called toner adhesion in the reference, while maintaining good required properties such as chargeability, transferability and fusibility. The authors do not discuss the light scattering properties of such toner particles.

U.S. Patent Application Publication 2013/0011782 to Sano et. al. discloses polymer-expanded particles, methods to prepare polymer-expanded particles, and expanded toner prepared by such a method. The preparation includes mixing and impregnating toner with high pressure gas or supercritical fluid, followed by reducing pressure and temperature to expand the toner material (generate porosity), which is then crushed and classified to the desired toner particle size. The authors do not discuss the light scattering properties of such toner particles.

U.S. Pat. No. 9,005,867 to Mang et. al. discloses a process to prepare porous toner particles by a variant of the emulsion aggregation toner method. Emulsion aggregation toner is prepared by controlled aggregation of an aqueous emulsion of resin particles, pigment particles and other optional toner addenda such as wax particles. The authors show how washing the filter cake from a slurry of emulsion aggregation toner particles with an alcohol results in porous toner particles. Advantages of porous toner particles are said to include requiring less toner mass to accomplish similar imaging results, thus lowering cost per page, providing a thinner image to reduce curl and image relief, saving fusing energy and providing a look and feel similar to offset printing (see col. 2, lines 37-53). The authors do not discuss the light scattering properties of such toner particles.

Commonly-assigned U.S. Pat. No. 4,833,060 to Nair et. al., which is incorporated herein by reference, describes the preparation of toner or polymer particles by a technique called evaporative limited coalescence (ELC). Toner ingredients such as the binder resin, colorants, waxes and charge control agents are dissolved or dispersed in a water immiscible solvent such as ethyl acetate, forming an oil-phase. This solution is then sheared into an aqueous mixture including a surface-active promoter polymer and colloidal silica as a particulate stabilizer to form oil-phase droplets the size of which are controlled by the amount of colloidal silica added. The pH of the aqueous phase can be controlled by a buffer. The solvent is then evaporated to form solid toner or polymer particles. After the shearing step, the colloidal silica functions to limit the coalescence of oil-phase droplets into larger droplets when the surface concentration of the silica on the droplets becomes approximately a monolayer. Thus, using more silica results in greater particle surface area, and thus smaller droplets and smaller resulting solid particles after solvent removal. The evaporative limited coalescence method as described produces resin particles or toner particles that have a very narrow distribution of particle sizes, which are solid without porosity. The colloidal silica can be removed by treatment in an alkaline aqueous solution, and the particles can be washed of aqueous phase salts. Further additives such as flow aids can be applied to the surface of the toner as needed. The shape of such particles can be varied by adding a shape control agent which tends to bind together the colloidal silica on the surface of the oil-phase droplets such that more surface area of the final solid particle results after the evaporation step to remove the solvent. Commonly-assigned U.S. Pat. No. 6,207,338 to Ezenyilimba et. al., U.S. Pat. No. 6,380,297 to Zion et. al., and U.S. Pat. No. 6,482,562 to Ezenyilimba et. al., each of which are incorporated herein by reference, describe preferred embodiments of shape control methods which can be used to prepare toner using the evaporative limited coalescence process. Shapes can range from spheroidal to highly folded and oblong. The shaped toners described by these references are solid without porosity.

Commonly-assigned U.S. Pat. No. 7,754,409 to Nair et. al., which is incorporated herein by reference, describes a method of manufacturing porous toner particles including: providing a first emulsion of a first aqueous phase comprising a pore stabilizing hydrocolloid dispersed in an organic solution containing a polymer; dispersing the first emulsion in a second aqueous phase; and evaporating the organic solution from the droplets to form porous toner particles of a controlled size and size distribution. This is commonly known as the evaporative limited coalescence process when a particulate material such as colloidal silica is used to stabilize the oil in water emulsion. The pores are created by the presence of the hydrocolloid stabilizer contained in the first aqueous phase, which is dispersed in the organic solution phase. Toner ingredients such as pigments, waxes and charge control agents can by dissolved or dispersed in the organic solution. A second double emulsion process is described where the organic phase comprises polymerizable monomers resulting in porous particles after polymerization. The disclosure states that "there is a need to reduce the amount of toner applied to a substrate in the electrophotographic process. Porous toner particles in the electrophotographic process can potentially reduce the toner mass in the image area. Simplistically, a toner particle with 50% porosity should require only half as much mass to accomplish the same imaging results. Hence, toner particles having elevated porosity will lower the cost per page and decrease the stack height of the print as well. The application of porous toners provides a practical approach to reduce the cost per print and improve the print quality" (see col. 2). The authors do not discuss the light scattering properties of such toner particles.

Commonly-assigned U.S. Pat. No. 7,867,679 to Nair et. al., which is incorporated herein by reference, describes porous toner particles prepared by a variant of the evaporative limited coalescence technique previously described. Two solvents are used in the oil-phase, where the second less volatile organic solvent is a poor solvent for the binder resin. Non-ionic organic polymer particles are added to stabilize pores which are created when the solvents are evaporated. The advantage of such porous toner is said to be a reduction in the toner mass in the image area, which will reduce toner cost per printed page. The thinner image is said to improve image quality, reduce curl, reduce image relief, save fusing energy and offer a look and feel closer to offset printing. The authors do not discuss the light scattering properties of such toner particles.

Commonly-assigned U.S. Pat. No. 7,887,984 to Nair et. al., which is incorporated herein by reference, describes porous toner particles prepared by a variant of the evaporative limited coalescence technique previously described. A preferred embodiment uses a double emulsion method where a first aqueous-phase with a dissolved hydrocolloid such as carboxy methyl cellulose resin is dispersed in an oil-phase containing dissolved or dispersed toner ingredients such as resins, pigments, waxes and charge control agents. The oil-phase solvent is immiscible in water such that the oil-phase which contains droplets of the first aqueous phase can itself be dispersed as droplets within a second aqueous phase comprising a particulate stabilizer such as colloidal silica. After evaporation of the solvent and water, pores are formed from the first aqueous phase droplets within the oil-phase containing the necessary toner ingredients. The particles have a porosity of at least 10%. The advantage of such porous toner particles is said to be a reduction in the amount of toner applied to the substrate by an electrophotographic process. Porosity can lower toner stack height, lower cost, and improve print quality. The authors do not discuss the light scattering properties of such toner particles.

Commonly-assigned U.S. Pat. No. 8,252,414 to Putnam et. al., which is incorporated herein by reference, describes porous particles and porous toner where an additive such as a pigment or wax needed for a toner composition can be incorporated into the pores (also known as microvoids). The particle preparative methods are variants of the evaporative limited coalescence process described in previously cited references. The advantage of such porous toner is said to be a reduction in the mass of toner in the image area, resulting in lower cost per page, lower toner stack height, and improved image quality. The authors do not discuss the light scattering properties of such toner particles.

Commonly-assigned U.S. Pat. No. 9,029,431 to Nair et. al., which is incorporated herein by reference, describes porous particles made by variants of the evaporative limited coalescence double emulsion method where a hydrocolloid is used to stabilize the cavities. The ability to vary the shape of such particles is discussed in column 13. Such porous particles are said to be useful for chromatographic columns, ion exchange and adsorption resins, drug delivery devices, cosmetic formulations, papers and paints. Previous patents that describe the use of such particles as toner are mentioned. However, the authors do not discuss the light scattering properties of such toner particles.

Commonly-assigned U.S. Pat. No. 9,376,540 to Boris et. al., which is incorporated herein by reference, describes porous polymer particles prepared by the evaporative limited coalescence double emulsion process that have discrete pores of different pore sizes stabilized by different hydrocolloids. The authors state that "Porous polymeric particles of controlled size are useful in diverse applications such as physical spacers, gaseous absorbers, optical barrier and diffusers, permeable barriers, electrophotographic toners, lubricants, desiccants and dispersive media. Porous polymeric particles having discrete pores of controlled size are likewise of technological importance to these and other applications where precise control of particle density, optical scatter, particle modulus, or elasticity or internal porous surface area is advantageous." However, the scattering properties of porous color toner particles are not further mentioned or detailed.

Commonly-assigned U.S. Patent Application Publication 2012/0077000 to Putnam et al., which is incorporated herein by reference, describes voided or porous toner particles prepared by a chemical method. An improved image fusing process is realized with the combination of specified fuser topcoat properties and toner with pores or voids. It is shown that, compared with solid toner, porous toner results in reduced relief of the toner image, reduced lateral spread of the image during fusing, and reduced fusing conditions. However, the scattering properties of voided color toner particles are not mentioned. It should be noted that porous toner particles collapse to solid films during the toner fusing process.

There remains a need for improved toner coverage sensing systems for electrophotographic printers that provide a higher measurement sensitivity compared to prior art configurations.

SUMMARY OF THE INVENTION

The present invention represents a toner coverage sensing system for sensing toner particles printed onto a surface of a process element using an electrophotographic printing system, the printed toner particles including printed porous color toner particles, including:

an optical sensing system including:

an infrared radiation source that directs infrared radiation in an infrared wavelength band onto the printed toner particles on the surface of the process element; and a diffused radiation detector for sensing infrared radiation scattered from the printed porous color toner particles on the surface of the process element, wherein the diffused radiation detector is oriented such that the sensed infrared radiation does not include specular reflections from the surface of the process element; and a data processing system that determines a sensed toner coverage for the porous color toner particles on the surface of the process element responsive to the sensed scattered infrared radiation;

wherein the porous color toner particles absorb less than 5% of the radiation in the infrared wavelength band.

The invention provides an improved signal level for color toners using colorants that are not detected by sensors operating at infrared wavelengths. Rather than detecting light reflected by the colorants, the sensor detects light scattered by the toner particles. The improvement is realized as the light scattered by the outer surfaces of the toner particles is enhanced by the light scattered by the voids within the porous toner particles, resulting in an increase in the sensitivity of the sensor and an increase in the robustness of the sensing process.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 1:
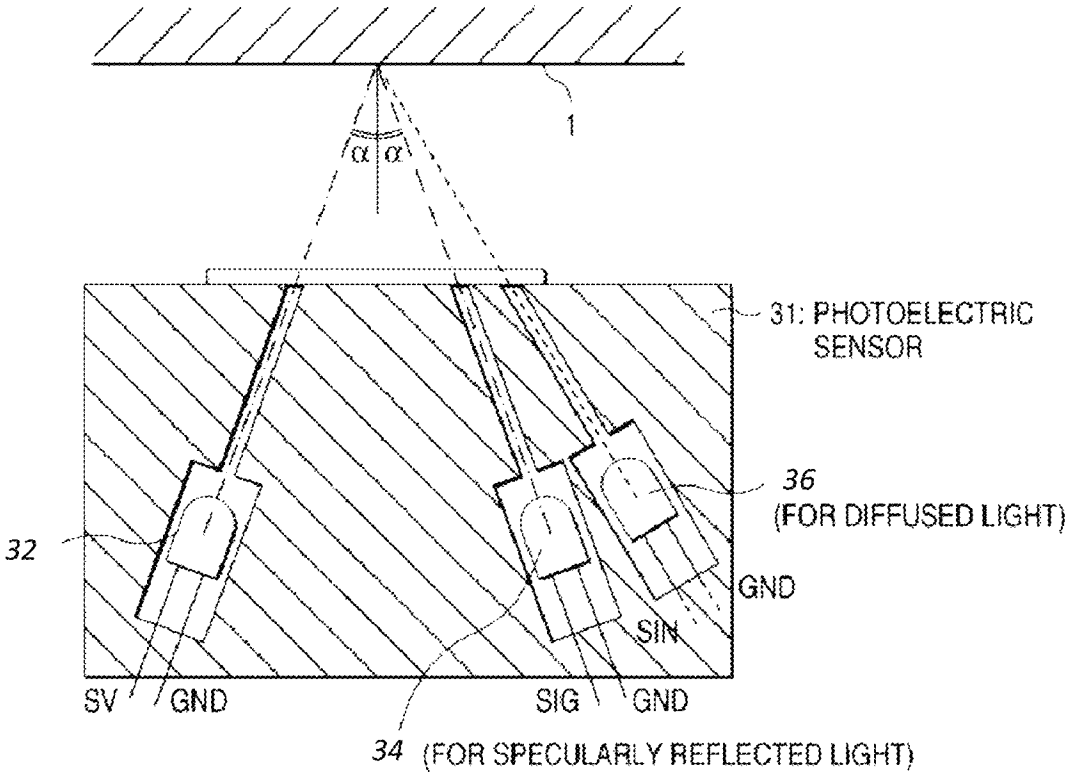
FIG. 1 (Prior Art)
FIG. 1 shows a cross-sectional view of an infrared process control toner coverage sensor with separate photoelectric detectors for specularly reflected and diffusely reflected light.

Prior art toner coverage sensing systems using infrared radiation, such as that described with respect to FIG. 1, rely on optical scattering characteristics of the toner to sense a toner coverage of color toners which do not absorb significantly in the infrared wavelength range. With conventional solid toners, the measurement sensitivity using such toner coverage sensing systems is limited by the amount of light scattering provided by the toner particles.

Inventors have discovered that use of porous toner particles in an electrophotographic printing system will produce improved measurement sensitivity, and therefore higher signal-to-noise ratios, in a toner coverage sensing system than are achievable with solid toner particles due to an increased level of light scattering (i.e., light diffusing) by the presence of cavities containing air when compared to the scattering properties of solid toner. In a preferred configuration, the porous toner particles have a porosity of at least 10%, wherein the porosity is measured by the method described in the aforementioned U.S. Pat. No. 7,887,984. Therefore, the present invention provides an improvement to the sensing of the cyan, magenta and yellow toner deposits by providing porous toner particles which scatter infrared light and thus increase the sensitivity and robustness of the toner coverage sensing process.

None of the prior art references discussed earlier describe or suggest a toner coverage sensing system in which toner coverage levels of porous toner particles are sensed using a detector oriented to collect scattered or diffused infrared radiation. Nor is there any recognition that enhanced scattering characteristics that can be achieved using porous toner particles can be used to provide improved sensitivity characteristics in a toner coverage sensing system.

The porous toner particles of this invention can be prepared using any method known in the art including the porous particle fabrication processes described earlier in the background section. Examples of such porous particle fabrication processes would include methods that employ multiple emulsions with either solvent evaporation or polymerization as the hardening mechanisms, methods that employ extraction of removeable components, variants of aggregation methods such as emulsion aggregation, and expansion methods such as foaming with a gas.

The inventive examples described in the present disclosure are all based on porous toner samples prepared by the evaporative limited coalescence technique using the double emulsion method with a hydrocolloid additive to create porosity, as described in the aforementioned, commonly-assigned U.S. Pat. Nos. 7,887,984 and 9,029,431. The preparative formulations were adjusted such that a porosity of about 40% was obtained with pores averaging about 0.7 microns in size with the toner particles themselves at about 6 microns in volume median diameter. Comparative examples utilize commercially available color toners as well as solid toners prepared in the present laboratory by the evaporative limited coalescence method as described in the aforementioned, commonly-assigned U.S. Pat. Nos. 4,833,060, 6,207,338, 6,380,297 and 6,482,562.

Table 1 describes the toner samples prepared in the inventors' laboratory by the evaporative limited coalescence process, which are either porous or solid. The pigments used are given by the abbreviated color index identification. Table 2 describes a set of commercially obtained toner samples which are used for comparative examples.

TABLE 1

Example toners fabricated in inventors' laboratory

| Example Toner | Colorant(s) | Aspect Ratio | $D_{vol}$ (microns) |
|---|---|---|---|
| Porous ELC Toner 1 | P.R. 122/P.R. 185 | 0.67 | 6.2 |
| Porous ELC Toner 2 | P.R. 122/P.R. 185 | 0.69 | 6.2 |
| Porous ELC Toner 3 | P.B. 15:3 | 0.82 | 6.1 |
| Porous ELC Toner 4 | P.B. 15:3 | 0.82 | 6.1 |
| Porous ELC Toner 5 | P.Y. 155 | 0.85 | 6.2 |
| Porous ELC Toner 6 | P.Y. 155 | 0.87 | 5.9 |
| Porous ELC Toner 7 | P.B. 15:3 | 0.89 | 5.8 |
| Porous ELC Toner 8 | P.B. 15:3 | 0.90 | 6.0 |
| Porous ELC Toner 9 | P.B. 15:3 | 0.96 | 6.6 |
| Porous ELC Toner 10 | carbon/P.B. 15:3 | 0.81 | 6.5 |
| Porous ELC Toner 11 | carbon/P.B. 15:3 | 0.96 | 6.2 |
| Solid ELC Toner 1 | P.B. 15:3 | 0.77 | 5.9 |
| Solid ELC Toner 2 | P.B. 15:3 | 0.81 | 5.9 |
| Solid ELC Toner 3 | P.B. 15:3 | 0.82 | 6.2 |
| Solid ELC Toner 4 | P.B. 15:3 | 0.82 | 6.1 |
| Solid ELC Toner 5 | P.B. 15:3 | 0.83 | 5.8 |
| Solid ELC Toner 6 | P.B. 15:3 | 0.84 | 5.9 |
| Solid ELC Toner 7 | P.Y. 155 | 0.87 | 5.5 |
| Solid ELC Toner 8 | P.B. 15:3 | 0.87 | 5.9 |
| Solid ELC Toner 9 | P.B. 15:3 | 0.89 | 5.9 |
| Solid ELC Toner 10 | P.B. 15:3 | 0.90 | 5.9 |
| Solid ELC Toner 11 | P.B. 15:3 | 0.90 | 6.7 |
| Solid ELC Toner 12 | P.R. 122/P.R. 185 | 0.91 | 6.6 |
| Solid ELC Toner 13 | P.Y. 155 | 0.91 | 6.1 |
| Solid ELC Toner 14 | P.R. 122/P.R. 185 | 0.96 | 6.3 |
| Solid ELC Toner 15 | P.B. 15:3 | 0.97 | 5.8 |
| Solid ELC Toner 16 | P.Y. 155 | 0.97 | 6.2 |
| Solid ELC Toner 17 | carbon/P.B. 15:3 | 0.84 | 6.0 |

TABLE 2

Commercially-available toner examples

| Example Toner | Source | Product | Color |
|---|---|---|---|
| Solid Toner A | Samsung | C5045 | C (cyan) |
| Solid Toner B | Samsung | M5045 | M (magenta) |
| Solid Toner C | Samsung | Y5045 | Y (yellow) |
| Solid Toner D | Samsung | K5045 | K (black) |
| Solid Toner E | Konica Minolta | TN616C | C |
| Solid Toner F | Konica Minolta | TN616M | M |
| Solid Toner G | Konica Minolta | TN616Y | Y |

The porous toner particles of this invention can be spherical or non-spherical depending upon the desired use. The shape of porous particles can be characterized by an "aspect ratio" that is defined as the ratio of the largest length of the particle which is perpendicular to the longest overall length of the particle (the "caliper diameter") to the longest overall length of the particle. These lengths can be determined for example by optical measurements using a commercial particle shape analyzer such as the Sysmex FP1A-3000 (Malvern Instruments). For example, porous particles that are considered "spherical" for this invention can have an aspect ratio of at least 0.95 and up to and including 1.0. For the non-spherical porous particles of this invention the aspect ratio can be at least 0.4 and up to and including 0.95. Table 1 includes aspect ratio measurement results for the toners prepared by the evaporative limited coalescence process in the present laboratory.

The porous color toner particles of the present invention can contain either dyes or pigments. Full color images are normally printed with four toners comprising cyan (C), magenta (M), yellow (Y) and black (K). Cyan toners utilize colorants that absorb largely red wavelengths, but not infrared wavelengths; magenta toners utilize colorants that absorb largely green wavelengths, but not infrared wavelengths; yellow toners utilize colorants that absorb largely blue wavelengths, but not infrared wavelengths; black toners based on carbon black as a colorant absorb all wavelengths of the visible spectrum, and also significantly absorb infrared wavelengths. (Within the context of the present disclosure, "significantly absorb" will be taken to mean absorbs at least 20% of radiation in the infrared wavelength band sensed by the toner coverage sensor 31 as measured in transmission at 0.4 mg/cm$^2$ toner coverage for a well fused sample on a clear support material as previously discussed.) For the purposes of discussion, we will refer to cyan, magenta and yellow toners as color toners, while black will not be considered to be a color toner. Color toners can also include colorants that are chosen to be used for "spot" or "accent" color reproduction, or color gamut enhancement. Examples include toners that would be considered to be red, blue, green, orange or violet, etc. Commercially available toner materials largely utilize pigments as colorants, however dyes are also represented. Useful cyan colorants include those with the Color Index designations of Pigment Blue 15, Pigment Blue 15:1, Pigment Blue 15:2. Pigment Blue 15:3, Pigment Blue 16 and Pigment Blue 79. Useful magenta colorants include those with the Color Index designations of Pigment Red 57:1, Pigment Red 81, Pigment Red 81:1, Pigment Red 122, Pigment Red 169, Pigment Red 185, and Pigment Violet 19. Useful yellow colorants include those with the Color Index designations of Pigment Yellow 12, Pigment Yellow 13, Pigment Yellow 17, Pigment Yellow 74, Pigment Yellow 155, Pigment Yellow 180, Pigment Yellow 185, Pigment Yellow 194 and Solvent Yellow 162. Useful colorants for accent, spot and gamut enhancement purposes include those with the Color index designations of Pigment Blue 61, Pigment Violet 1, Pigment Violet 3, Pigment Violet 23, Pigment Red 53:1, Pigment Red 53:3, Pigment Red 112, Pigment Red 146, Pigment Green 7, Pigment Orange 5, and Pigment Orange 34. This list should not be considered to be limiting as to which colorants are suitable to use in porous toner used in an electrophotographic printing process using a toner coverage sensor (i.e., a DMA sensor) operating at infrared wavelengths that detects scattered light. Color toners can utilize mixtures of colorants. Carbon black has the Color Index designation Pigment Black 7; toners based on carbon black absorb too much light at infrared wavelengths to be useful for measuring the infrared scattering in accordance present invention, and will be seen to be instructive as comparative examples to understand the nature of the invention.

The porous color toner particles of the present invention can be based on a variety of resin materials that are useful in dry toner based electrophotographic printing. Included are polyester resins, styrene-acrylic copolymer resins, epoxy resins, acrylic resins, hydrocarbon resins, bio-derived resins, and many other suitable materials. The porous toner particles can contain additives that are useful for other aspects of toner performance such as waxes including polyethylene waxes, ester waxes, paraffin waxes, and other suitable materials, charge control agents, adhesion promoting additives, anti-blocking additives, anti-microbial additives, magnetic additives, conductive additives, and others.

A desktop device that can directly measure the Image Density Control (IDC) or Developed Mass per unit Area (DMA) response of a color printer to toner deposits was fabricated by using the IDC sensor of a Samsung Xpress C1810W printer. FIG. 1 describes the underlying geometry of this sensor. The Samsung Xpress C1810W IDC sensor contains an infrared LED emitter element 32 as the toner patch illuminant and two photoelectric sensors with the geometry defined so that one sensor (specular radiation detector 34) detects specularly reflected light and the second sensor (diffused radiation detector 36) detects diffused or scattered reflected light. The LED emission was measured to be centered at 930 nm. In an electrophotographic process the toner images used as test patches, transferred or developed onto process element 1, are transported past the toner coverage sensor 31 by the process element 1.

After measuring the IDC sensor bracket to intermediate transfer belt spacing in the Samsung Xpress C1810W printer, the IDC sensor was removed from the printer and mounted so that the IDC sensor bracket to toner deposit distance of 0.075" and the general sensor to toner patch geometry was duplicated. +5.2V DC was supplied to connector pin #2. Power supply ground was supplied to connector pin #3. A potentiometer was wired in series with the LED emitter ground return (connector pin #5) to control the output of the IDC sensor's LED emitter. The voltage drop across the potentiometer under the measurement conditions was 2.3 V. The output signals of the two photoelectric sensors were monitored by measuring the voltage on connector pins #1 and #4 relative to power supply ground.

The apparatus just described was used to study the sensor response to patches of toner prepared on a reflective black substrate such as the intermediate transfer belt taken from a Samsung Xpress C1810W printer. Patches of unfused toner were electrostatically coated on strips cut from the transfer belt, and measured for toner coverage (i.e., DMA) in units of milligrams per square centimeter (mg/cm$^2$). The electrostatic coating device comprised a small magnetic brush developer station with a 1 cm wide development zone that utilizes two-component development with strontium ferrite carrier. Direct toning of a strip of substrate that is transported at constant speed past the developing station was accomplished with application of a DC bias voltage applied to the toning roller. The weight and area of the toner patches were measured, and the coated strip was placed under the Samsung Xpress C1810W IDC sensor to record the output of both the scattered and reflected light photoelectric sensors. The patches were seen to be free of any magnetic carrier particles.

The toner coverage of the patches was controlled by the bias voltage level or the toner concentration of the developer loaded into the station. It was learned that reflective black coated paper from the Leneta Company as Opacity Charts Form 2A, could be used instead of strips cut from an intermediate transfer belt with no change in the resulting sensor output vs. toner coverage relationship. All of the data reported in this disclosure were prepared on this black reflective paper substrate.

Table 3 describes both inventive examples and comparative examples of toner coverage sensing (i.e., DMA sensing) of toner deposits in reflection with the materials listed in Table 1 and Table 2. Table 4 describes inventive and comparative examples of toner coverage sensing of toner deposits in transmission with materials listed in Table 1 and Table 2.

TABLE 3

Toner coverage sensing examples (in reflection)

| Example | Sensor Geometry | Toner Example(s) | Color | Signal at 0.4 mg/cm$^2$ |
|---|---|---|---|---|
| Inventive Ex. 1 | diffuse | Porous ELC Toner 4 | C | 2.55 |
| Inventive Ex. 2 | diffuse | Porous ELC Toner 1 | M | 2.56 |

TABLE 3-continued

Toner coverage sensing examples (in reflection)

| Example | Sensor Geometry | Toner Example(s) | Color | Signal at 0.4 mg/cm$^2$ |
|---|---|---|---|---|
| Inventive Ex. 3 | diffuse | Porous ELC Toner 5 | Y | 2.47 |
| Inventive Ex. 4 | specular | Porous ELC Toner 4 | C | 1.02 |
| Inventive Ex. 5 | specular | Porous ELC Toner 1 | M | 1.03 |
| Inventive Ex. 6 | specular | Porous ELC Toner 5 | Y | 0.99 |
| Inventive Ex. 7 | diffuse | Porous ELC Toners 1-9 | C, M, Y | |
| Comp. Ex. 1 | diffuse | Solid Toner A | C | 1.59 |
| Comp. Ex. 2 | diffuse | Solid Toner B | M | 1.59 |
| Comp. Ex. 3 | diffuse | Solid Toner C | Y | 1.58 |
| Comp. Ex. 4 | specular | Solid Toner A | C | 0.57 |
| Comp. Ex. 5 | specular | Solid Toner B | M | 0.55 |
| Comp. Ex. 6 | diffuse | Solid Toner C | Y | 0.56 |
| Comp. Ex. 7 | diffuse | Solid Toner E | C | 1.34 |
| Comp. Ex. 8 | diffuse | Solid Toner F | M | 1.40 |
| Comp. Ex. 9 | diffuse | Solid Toner G | Y | 1.26 |
| Comp. Ex. 10 | diffuse | Solid ELC Toners 1-16 | C, M, Y | |
| Comp. Ex. 11 | diffuse | Solid Toner D | K | 0.138 |
| Comp. Ex. 12 | diffuse | Solid ELC Toner 17 | K | 0.126 |
| Comp. Ex. 13 | diffuse | Porous ELC Toner 10 | K | 0.186 |
| Comp. Ex. 14 | diffuse | Porous ELC Toner 11 | K | 0.205 |
| Comp. Ex. 15 | specular | Solid Toner D | K | 0.079 |
| Comp. Ex. 16 | specular | Solid ELC Toner 17 | K | 0.069 |
| Comp. Ex. 17 | specular | Porous ELC Toner 10 | K | 0.079 |
| Comp. Ex. 18 | specular | Porous ELC Toner 11 | K | 0.090 |

TABLE 4

Toner coverage sensing examples (in transmission)

| Example | Sensor Geometry | Toner Example(s) | Color | Signal at 0.4 mg/cm$^2$ |
|---|---|---|---|---|
| Inventive Ex. 8 | Transmission | Porous ELC Toner 4 | C | 0.286 |
| Comp. Ex. 19 | Transmission | Solid Toner A | C | 0.107 |

Figure 4:
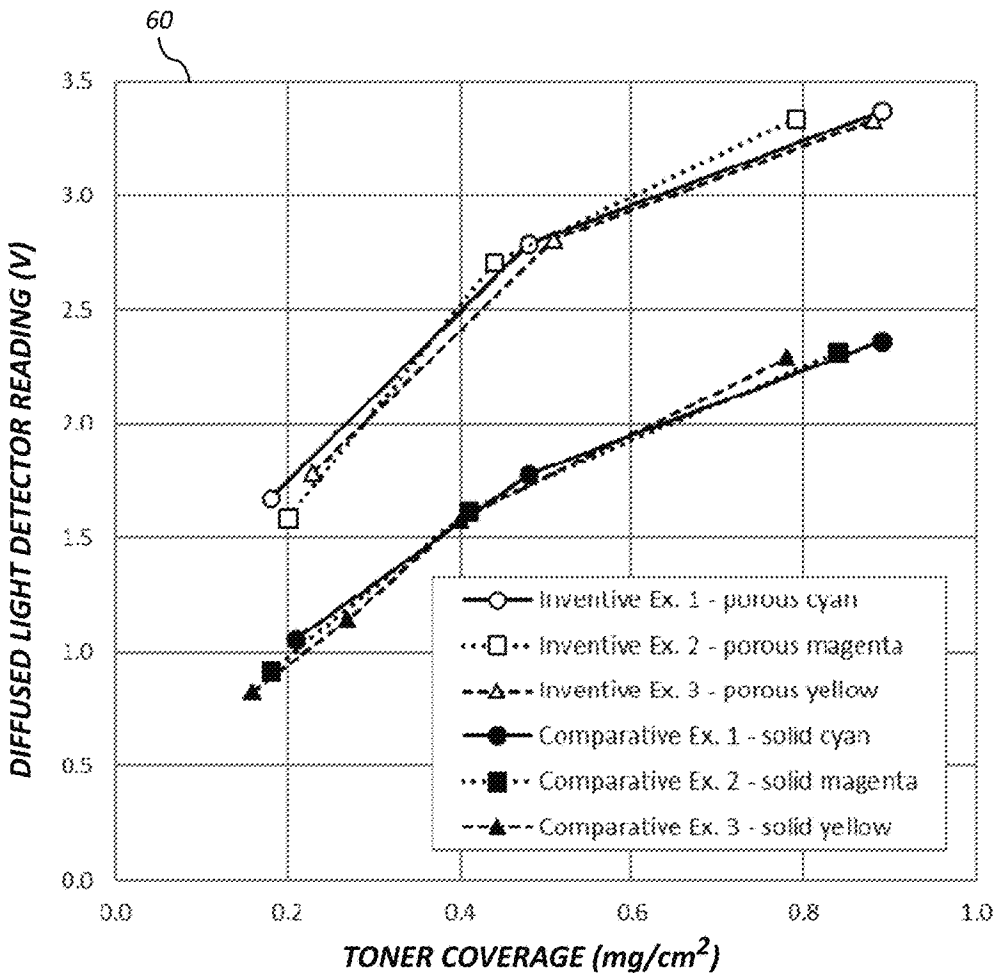
FIG. 4 is a graph showing diffused light detector signal as a function of toner coverage for porous and solid color toners.

FIG. 4 shows a graph 60 of the output of the diffused light sensor 36 (FIG. 1) as a function of toner coverage (developed mass per area) in units of mg/cm$^2$ for inventive examples with porous toner particles, and comparative examples with solid toner particles. Inventive Examples 1, 2 and 3 used cyan, magenta and yellow porous toners, respectively. Comparative Examples 1, 2 and 3 illustrate the sensing of the solid cyan, magenta and yellow toners sold with the Samsung Xpress C1810W printer from which the sensor itself was removed. It is seen that as toner coverage is increased, the sensor signal increases for all the inventive and comparative examples, but that the signals are approximately 50% to 60% larger for the inventive porous toner sensing examples. In preferred embodiments, the porous nature of the porous toner particles causes the sensed scattered infrared radiation from the printed porous color toner particles to be at least 20% higher than would be sensed for printed non-porous color toner particles having the same pigment and resin and a substantially equivalent particle geometry and toner coverage. Within the context of the present disclosure, a substantially equivalent particle geometry is one having the same size and aspect ratio distributions to within 10%, and a substantially equivalent toner coverage is one having the same mass per unit area to within 5%. It is seen that for both types of toner there is no significant difference in signal levels among the cyan, magenta and yellow samples.

Figure 3:
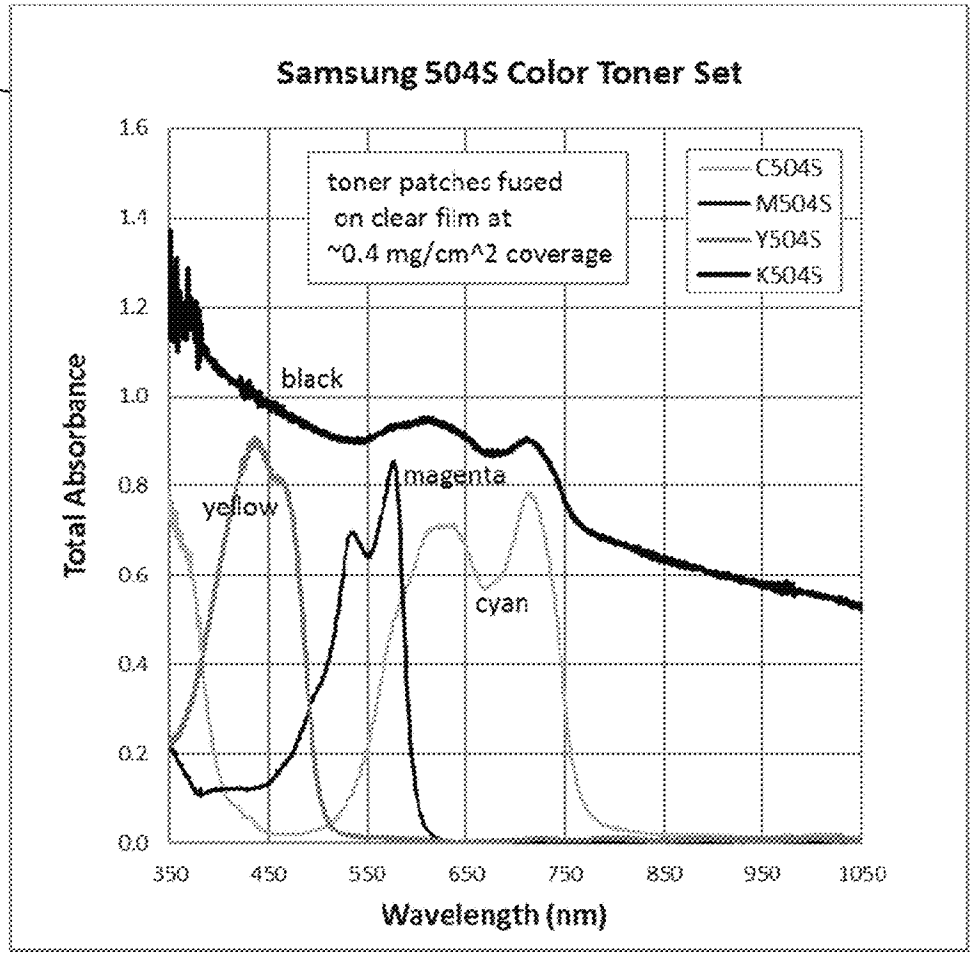
FIG. 3 (Prior Art)
FIG. 3 is a graph illustrating absorbance spectra for an exemplary set of cyan, magenta, yellow and black toners.

FIG. 3 discussed previously demonstrates that the solid toners of Comparative Examples 1, 2 and 3 do not absorb light at the 930 nm wavelength of the sensor; this is also the case for the colorants used in the inventive samples. The sensor response with comparative solid toners is due to light scattered from the surfaces of the unfused toner particles. The signal is enhanced for the inventive porous toners by scattering of light from the internal pores of the toner particles.

The data of FIG. 4 were fit with a second order polynomial in order to interpolate the sensor response at 0.4 mg/cm$^2$, which approximates the toner coverage of monochrome process color maximum density areas of modern electrophotographic printers using toner of about 6 microns in diameter. These values are listed in Table 3, along with a description of Inventive Examples 1, 2 and 3, and Comparative Examples 1, 2 and 3.

Figure 5:
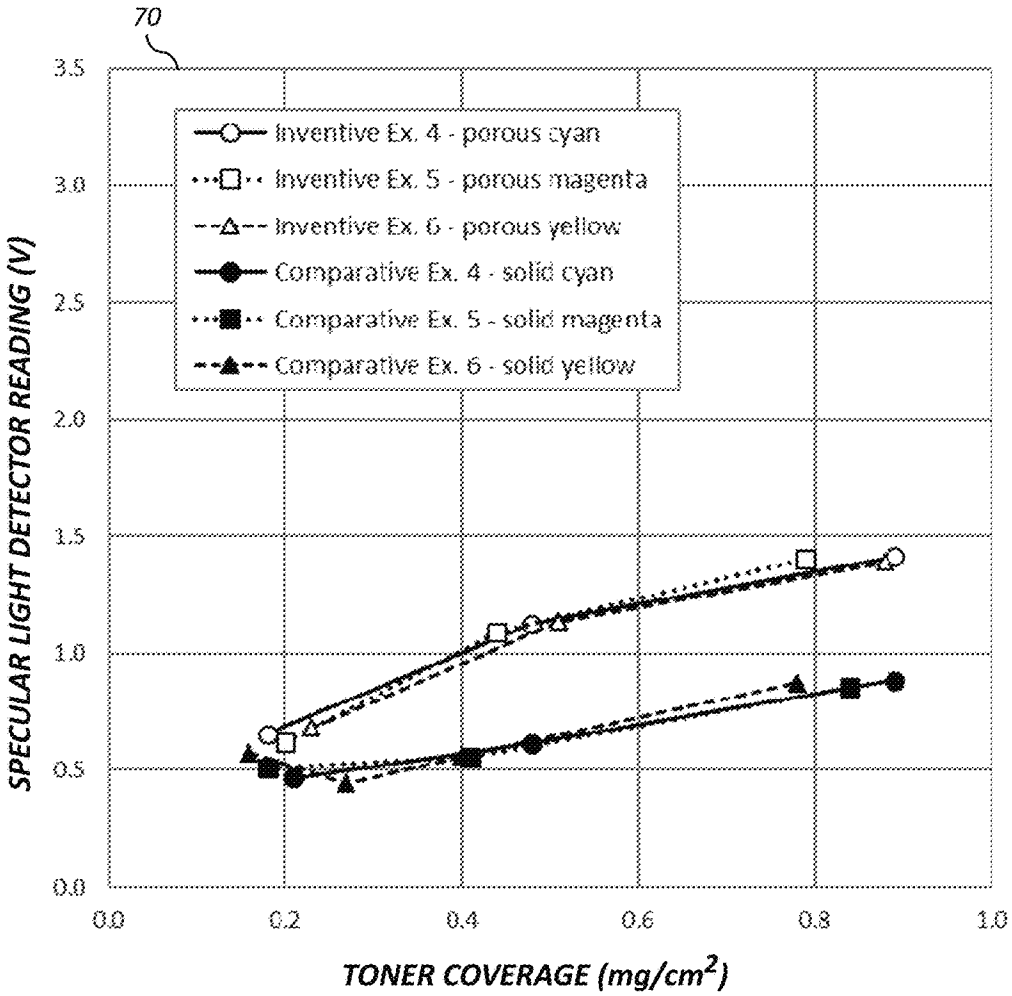
FIG. 5 is a graph showing specular light detector signal as a function of toner coverage for porous and solid color toners.

FIG. 5 shows a graph 70 of the response of the specular light sensor 34 (FIG. 1) oriented to collect specularly reflected light to the same toner patches on black reflective paper that were tested for the response of the diffused light sensor 36 as shown in FIG. 4. It is seen that the sensor reading in FIG. 5 for both solid and porous toners are much lower than those in FIG. 4. However, the signal output values with porous cyan, magenta and yellow toner particles (i.e., Inventive Examples 4, 5 and 6) are much higher than those with solid cyan, magenta and yellow toner particles (i.e., Comparative Examples 4, 5 and 6). The values of a second order polynomial fit to these data evaluated at 0.4 mg/cm$^2$ are included in Table 3. It is seen that the use of porosity in color toner particles allows for the use of the specular radiation detector 34 oriented to collect specularly reflected light to measure toner coverage as there is a substantial slope to the signal vs. toner coverage relationship over the useful range of toner coverage of approximately 0.25 to 0.45 mg/cm$^2$ for modern 6 micron diameter toners, while the signal for solid toner particles over this range is essentially flat and would not be useful in controlling the amount of toner on a printed page.

FIGS. 4 and 5 illustrate the much improved signal level and robustness of sensing toner coverage in an electrophotographic printing system using the combination of porous toner particles and a toner coverage sensor operating at infrared wavelengths, especially one oriented to collect diffused light. Further, the use of porous toner particles offers the possibility of using a simpler and less expensive sensor that only collects specular light at the equivalent angle to the emitter as demonstrated by FIG. 5.

Figure 2:
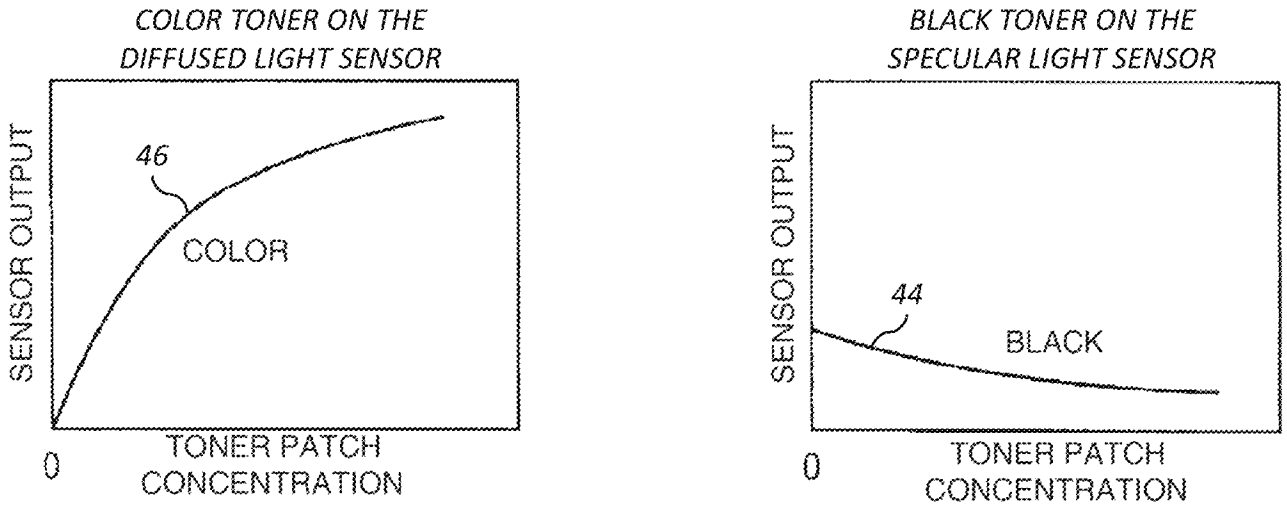
FIG. 2 (Prior Art)
FIG. 2 shows graphs illustrating the response of the diffused light sensor to color toner coverage and the specular light sensor to black toner coverage.

It is shown in FIG. 2 that for black toner using a geometry selected for specularly reflected light, the signal decreases as the toner coverage of the toner is increased. This is expected since black absorbs infrared light, thus the higher the coverage of black toner, the less light will be reflected and collected by the photoelectric sensor. In the case of Inventive Examples 4, 5 and 6 of FIG. 5 the presence of highly scattering porous toner will block light from being reflected into the specular radiation detector 34, however it will also scatter light at all angles including into the specular radiation detector oriented at the equivalent angle to the emitter. The latter is clearly the dominant phenomena which results in a higher signal with increasing toner coverage. With the solid color toners in Comparative Examples 4, 5 and 6, the blockage of reflected light which would lower the signal is compensated for by a degree of scattering, resulting in an essentially flat signal with toner coverage over the useful range and is thus useless as a printing process control sensor. Toner porosity is seen to enable a useful sensing of color toners for the geometry where the emitter and collector are oriented at equivalent angles.

Comparative Examples 7, 8 and 9 listed in Table 3 include the interpolated signal data from patches of Solid Toner Examples E, F and G, comprising cyan, magenta and yellow solid toners from a Konica Minolta C6000 printer. These toners are known to be manufactured by an emulsion aggregation chemical process as are the cyan, magenta and yellow toners from the Samsung Xpress C1810W. The diffused radiation detector signals are seen to be higher for the Samsung than the Konica Minolta materials. Cyan, magenta and yellow toners gave 1.59, 1.59, 1.58 volts, respectively, for Solid Toner Examples A, B, C (i.e., the Samsung toners) used in Comparative Examples 4, 5 and 6 compared to 1.34, 1.40, 1.26 volts for Solid Toner Examples E, F, G (i.e., the Konica Minolta toners) used in Comparative Examples 7, 8 and 9. When examined with a scanning electron microscope, the Konica Minolta toners appear smoother and rounder than the Samsung toners, which appear relatively more folded and oblong. Toner particle shape is thus seen to be a strong factor in the degree of scattering of infrared light; shape can be affected by toner manufacturing process variability and thus there is a need for a sensing process that is more robust to toner shape variation in order to be effective with a range of toner geometries.

Figure 6:
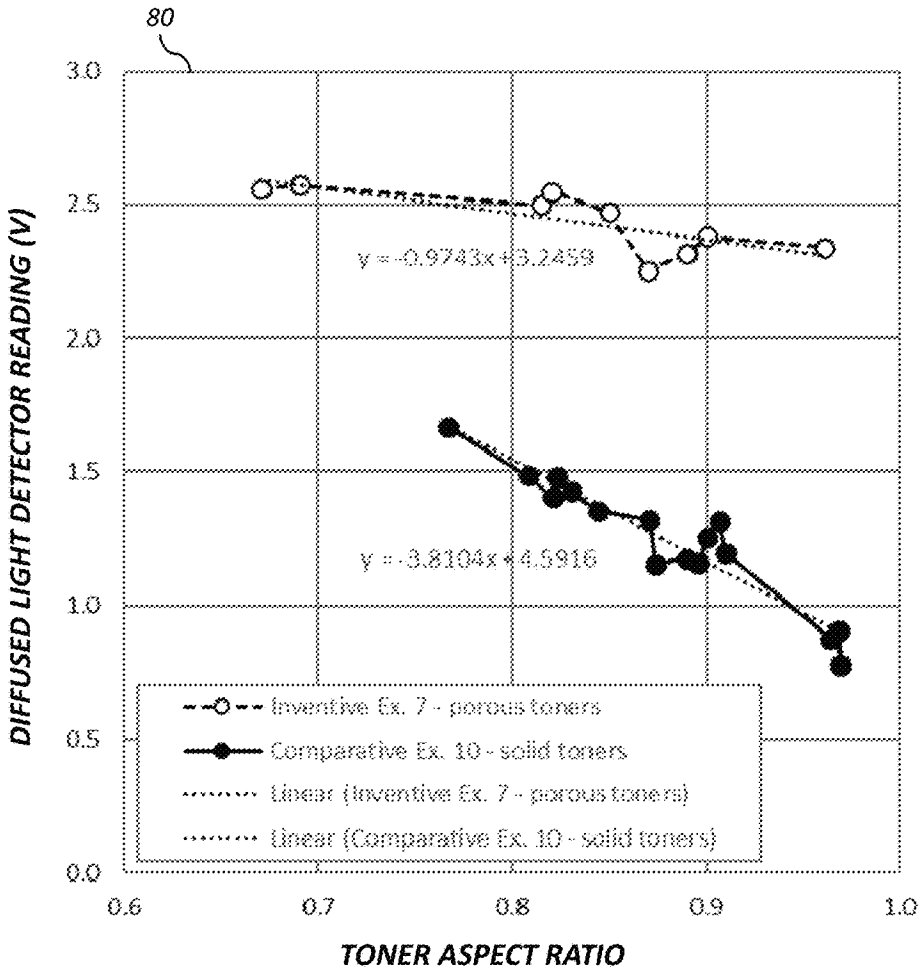
FIG. 6 is a graph showing diffused light detector signal at a specified toner coverage for porous and solid color toners as a function of toner aspect ratio.

FIG. 6 shows a graph 80 of the diffused radiation detector signal at a toner coverage of 0.4 mg/cm$^2$ as a function of toner aspect ratio for the porous and solid toners made by the evaporative limited coalescence process as described in Table 1. Diffused radiation detector data for Inventive Example 7 (corresponding to Porous ELC Toner Examples 1-9), and Comparative Example 10 (corresponding to Solid ELC Toner Examples 1-16), are plotted in the order presented in Table 1. Color toners including cyan, magenta and yellow are included for each curve. Recall that the aspect ratio used here is defined as the ratio of the largest perpendicular length to the longest length of a toner particle; perfect spheres would have an aspect ratio of 1.0. It is seen that the more the shape difference from perfect spheres (i.e., the lower the aspect ratio), the higher is the sensor signal. However, the slope of the solid toner data (i.e. Comparative Example 10), is much higher (by about a factor of 4×), than that for the porous toner samples (i.e., Inventive Example 7). Therefore, the use of porous color toner particles is seen to result in toner coverage sensing which is much more robust to toner shape variation than with the use of solid color toner particles.

The sensing behavior of black toner including carbon black as a colorant is much different that the sensing behavior of color toners. Comparative Examples 11 to 14 of Table 3 describe the sensing of both porous black and solid black toner examples using the diffused radiation detector 36 oriented to collect diffused light, and Comparative Examples 15 to 18 of Table 3 describe the sensing both porous black and solid black toners using the specular radiation detector 34 oriented to collect specularly reflected light.

Figure 7:
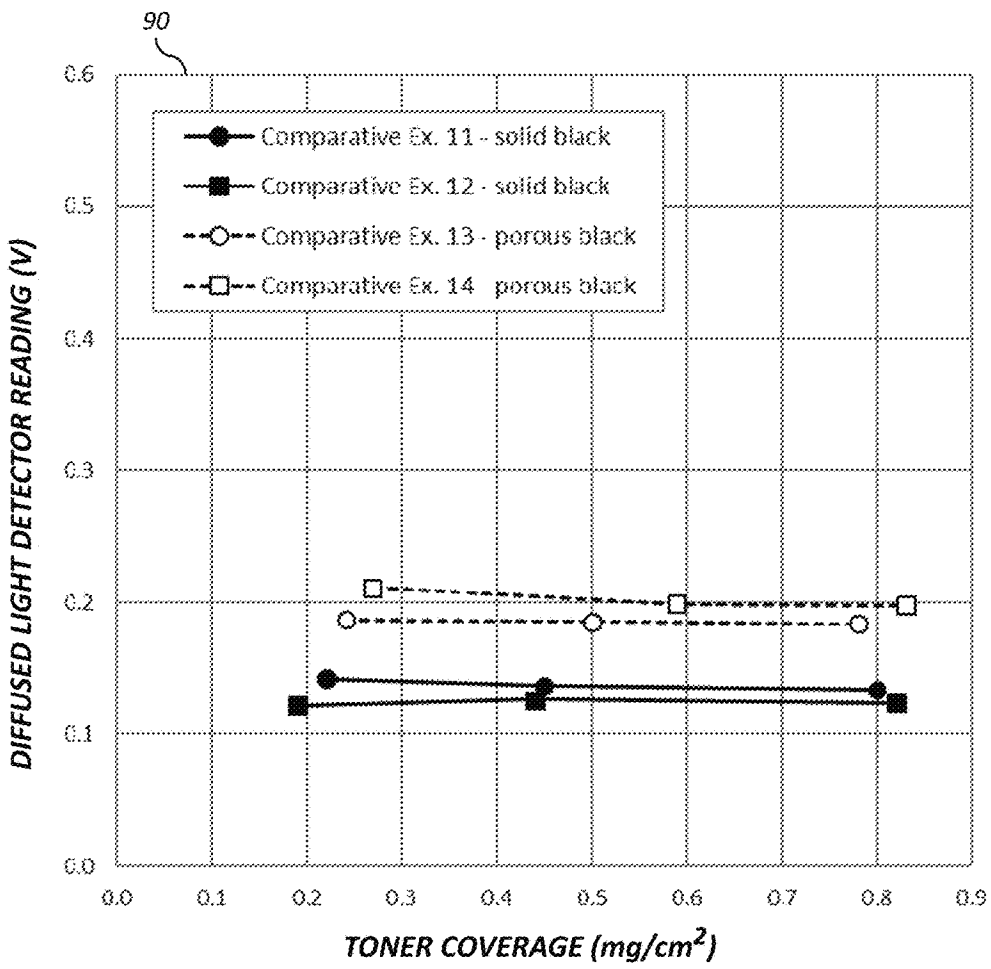
FIG. 7 is a graph showing diffused light detector signal as a function of toner coverage for porous and solid black toners.

FIG. 7 shows a graph 90 of diffused radiation detector signal as a function of toner coverage for Comparative Examples 11 to 14. It is seen for both the solid black toners (i.e., Comparative Examples 11 and 12) and porous black toners (i.e., Comparative Examples 13 and 14) that there is essentially no slope to the signal as a function of toner coverage, thus these sensing embodiments are not useful for process control of toner coverage in a printer. Therefore, it can be concluded that carbon-black-based black toners absorb the infrared emitter light too strongly to use the diffused radiation detector 36. For this reason, the specular radiation detector 34 is normally used to measure such black toners in a printer as was discussed earlier with respect to FIG. 2.

Figure 8:
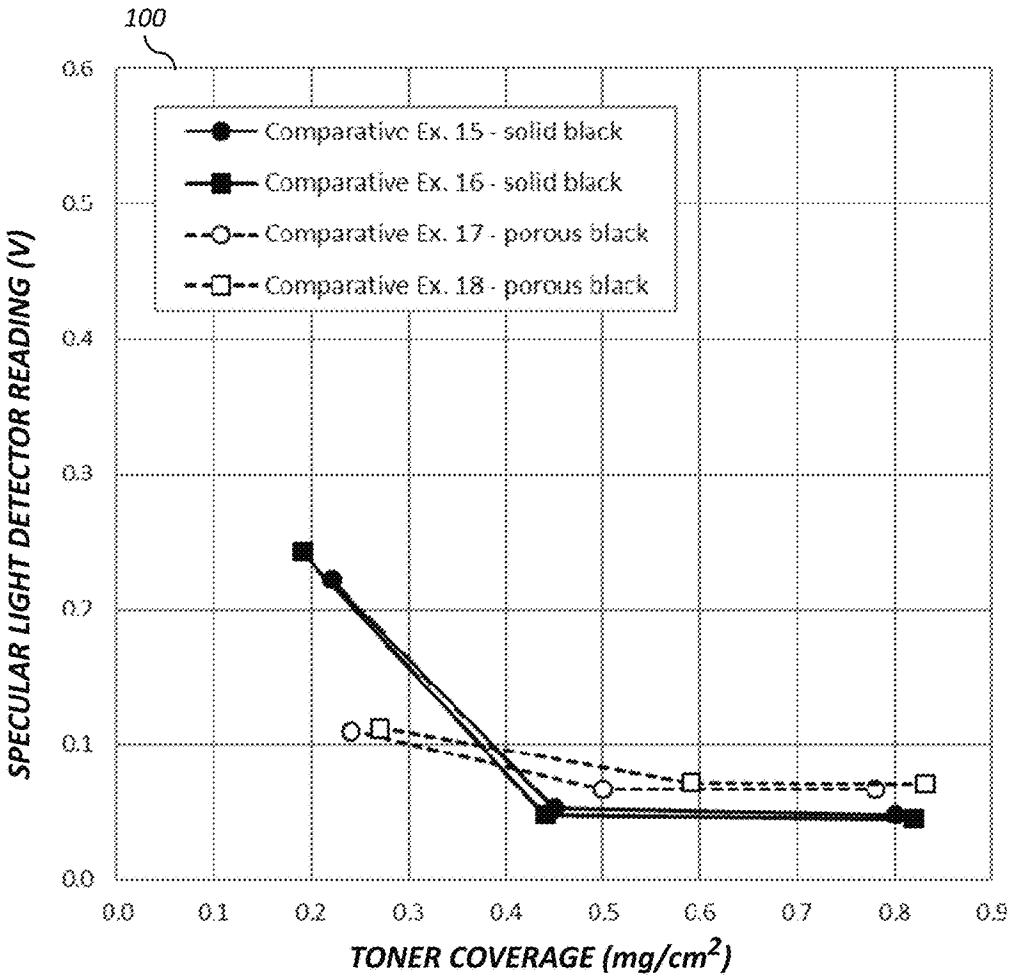
FIG. 8 is a graph showing specular light detector signal as a function of toner coverage for porous and solid black toners.

FIG. 8 shows a graph 100 of specular radiation detector signal as a function of toner coverage for Comparative Examples 15 to 18. Comparative Examples 11 and 15 use the Samsung K504S toner that is sold for with the Samsung Xpress C1810W printer from which the toner coverage sensor 31 was taken. It is seen from Comparative Example 15 in FIG. 8, that when this toner is sensed using the specular radiation detector 34, a slope in the signal as a function of toner coverage exists that can be used for electrophotographic process control. This is clearly how the Samsung Xpress C1810W functions. However, when compared to the behavior of the diffused light sensor with color toners, both solid and porous, in FIG. 4, it is seen that black toner is detected with much less sensitivity than the color toners.

It is seen in FIG. 8 that when sensing with the specular radiation detector 34, the addition of porosity to black toners comprising carbon black as a pigment (as in Comparative Examples 17 and 18) decreases the signal sensitivity to toner coverage, in contrast to the increase in sensitivity for Inventive Examples 4-6 with color toners as seen in FIG. 5. It should be noted that the solid and porous toner samples prepared by the evaporative limited coalescence process in the above discussion contain a major amount of carbon black plus a minor amount of Pigment Blue 15:3 as colorants; the latter is added to provide a hue that is a bluer, colder neutral rather than the browner, warmer hue that results from the use of carbon black alone.

The toner property that distinguishes the inventive sensing examples with color toners from the comparative sensing examples with black toners is the absorbance of infrared light by the black toners due to the use of carbon black as a colorant. A black toner can be prepared using an appropriate combination of color pigments such as cyan, magenta and yellow or a mixture of cyan, orange and violet, to yield a black hue. Based on the knowledge gained through the present investigation, it is expected that such a toner would be sensed properly by the diffused radiation detector 36 using infrared radiation, and would exhibit improved sensitivity and robustness with the addition of porosity. It is also expect that such a toner could be sensed in a useful manner by the specularly reflected light detector by the addition of porosity.

It is seen in FIG. 3 that the cyan, magenta and yellow colorants of a commercially available color toner set do not absorb significant levels of radiation in the range of 850 to 1050 nm wavelengths. The wavelength range of "infrared" light is commonly quoted as 700 nm to 1000 nm or higher. The portion of that range that could thus find utility in toner coverage sensing is at least 850 nm to 1050 nm. The toner coverage sensor 31 used in this study operates at 930 nm; sensors discussed previously in the prior art also operate in the mid 900s of nm. For the purposes of the present disclosure, the most useful color toners are those which do not absorb significant amounts (e.g., less than 5%) of infrared light above 850 nm.

The inventive and comparative sensing examples just described were all based on reflective sensing of toner patches on black reflective support with a commercially available toner coverage sensor 31 from a Samsung electrophotographic printer where the toner images to be sensed are located on an opaque black reflective intermediate transfer element. In other configurations, the toner coverage is measured on a transparent or semi-transparent process element. For example, in the Kodak NexPress SX3900 printer is performed on the intermediate transfer element, which is a belt that is transparent to both visible and infrared wavelengths of light. The Kodak NexPress SX3900 printer uses visible light sensing where red, green and blue wavelength emitters are located on one side of the intermediate transfer belt, with the corresponding photoelectric detectors being located on the opposite side of the intermediate transfer belt. Thus, this sensor utilizes transmitted light rather than reflected light as described in the previous examples.

Figure 9:
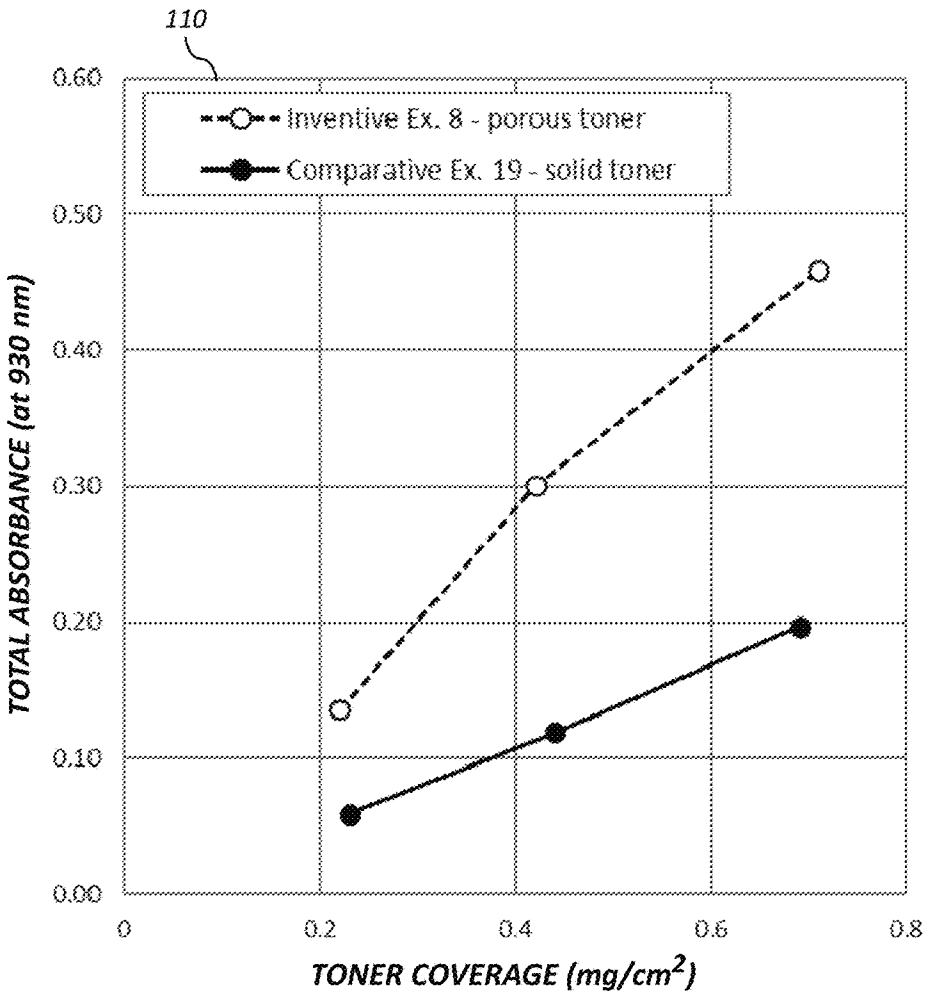
FIG. 9 is a graph of absorbance measured in transmission as a function of toner coverage for porous and solid color toners.

To illustrate toner coverage sensing at IR wavelengths in transmission geometry, a Perkin-Elmer UV-VIS model Lambda 35 spectrophotometer was used to simulate the operation of a transmission sensor designed to fit in an electrophotographic printer. Toner patches were electrostatically coated onto a clear support at a series of toner coverage levels. The "total absorbance" was measured for patches of a solid toner and a porous toner as described in Table 4. The Perkin-Elmer spectrophotometer was equipped with an integrating sphere detector that collects the forward scattered light that can be captured by the available geometry of the detector. The system can be configured to optionally include or exclude the specularly transmitted (i.e., "directly transmitted") light from the measurements. In a preferred configuration, the specularly transmitted light is excluded. The total absorbance at 930 nm is plotted vs. toner coverage in the graph 110 of FIG. 9. It is seen that the signal is about a factor of 2.5× higher for Inventive Example 8 with a porous toner relative to Comparative Example 19 with a solid toner. A toner coverage sensing process using porous toners in transmission is thus seen to be advantaged similar to the toner coverage sensing process using porous toners in reflection. It should be noted that in alternate embodiments it is not necessary to use an integrating sphere to collect the scatter radiation. Rather, a diffused radiation detector 36 can be positioned to collect transmitted scattered radiation within a particular range of scattering angles.

In the described examples, the process element 1 used for the toner coverage measurements has been an intermediate transfer element. In other embodiments, the process element 1 can be other types of media including photoconductor elements (e.g., photoconductor drums or belts), or the final receiver medium.

The invention has been described in detail with particular reference to certain preferred embodiments thereof, but it will be understood that variations and modifications can be effected within the scope of the invention.

PARTS LIST

1 process element
31 toner coverage sensor
32 emitter element
34 specular radiation detector
36 diffused radiation detector
44 sensor output
46 sensor output
50 graph
60 graph
70 graph
80 graph
90 graph
100 graph
110 graph

The invention claimed is:

1. A toner coverage sensing system for sensing toner particles printed onto a surface of a process element using an electrophotographic printing system, the printed toner particles including printed porous color toner particles, comprising:

an optical sensing system including:

an infrared radiation source that directs infrared radiation in an infrared wavelength band onto the printed toner particles on the surface of the process element; and a diffused radiation detector for sensing infrared radiation scattered from the printed porous color toner particles on the surface of the process element, wherein the diffused radiation detector is oriented such that the sensed infrared radiation does not include specular reflections from the surface of the process element; and a data processing system that determines a sensed toner coverage for the porous color toner particles on the surface of the process element responsive to the sensed scattered infrared radiation;

wherein the porous color toner particles absorb less than 5% of the radiation in the infrared wavelength band.

2. The toner coverage sensing system of claim 1, wherein the infrared wavelength band has a peak wavelength in the range of 850-1050 nm.

3. The toner coverage sensing system of claim 1, wherein the process element is a photoconductor element, an intermediate transfer element or a receiver medium.

4. The toner coverage sensing system of claim 1, wherein the diffused radiation detector is positioned on a same side of the process element as the infrared radiation source to sense reflected infrared radiation.

5. The toner coverage sensing system of claim 1, wherein the diffused radiation detector is positioned on an opposite side of the process element as the infrared radiation source to sense transmitted infrared radiation.

6. The toner coverage sensing system of claim 5, wherein the sensed transmitted infrared radiation is sensed using an integrating sphere.

7. The toner coverage sensing system of claim 5, wherein the sensed transmitted infrared radiation does not include specularly transmitted infrared radiation.

8. The toner coverage sensing system of claim 1, wherein the porous color toner particles have a porosity of at least 10%.

9. The toner coverage sensing system of claim 1, wherein the color toner particles have an aspect ratio in the range of 0.6 to 1.0.

10. The toner coverage sensing system of claim 1, wherein the sensed scattered infrared radiation from the printed porous color toner particles is at least 20% higher than would be sensed for printed non-porous color toner particles having a same pigment and resin and a substantially equivalent particle geometry and toner coverage as the printed porous color toner particles.

11. The toner coverage sensing system of claim 1, wherein the printed toner particles on the surface of the process element also include non-porous black toner particles, the non-porous black toner particles absorbing at least 20% of the radiation in the infrared wavelength band;

wherein the optical sensing system further includes a specular radiation detector oriented to sense infrared radiation specularly reflected from the surface of the process element; and wherein the data processing system determines a sensed toner coverage for the non-porous black toner particles on the surface of the process element responsive to the sensed specularly reflected infrared radiation.

12. The toner coverage sensing system of claim 1, wherein the printed toner particles are dry toner particles.

* * * * *